US008281430B1

(12) United States Patent
Hough et al.

(10) Patent No.: US 8,281,430 B1
(45) Date of Patent: Oct. 9, 2012

(54) SLING FOR EXTRACTING AND TRANSPORTING PEOPLE

(76) Inventors: Bill Harold Hough, Howell, MI (US); Chad Scott Frazier, Charlotte, MI (US); Laura Jean Frazier, Howell, MI (US)

( * ) Notice: Subject to any disclaimer, the term of this patent is extended or adjusted under 35 U.S.C. 154(b) by 488 days.

(21) Appl. No.: 12/455,414

(22) Filed: Jun. 2, 2009

Related U.S. Application Data

(60) Provisional application No. 61/104,049, filed on Oct. 9, 2008, provisional application No. 61/210,799, filed on Mar. 23, 2009.

(51) Int. Cl.
*A61G 1/013* (2006.01)
*A61G 1/044* (2006.01)
*A61G 7/10* (2006.01)

(52) U.S. Cl. ..... 5/89.1; 5/81.1 T; 5/625; 5/627

(58) Field of Classification Search ..... 5/89.1, 5/81.1 T, 81.1 R, 625, 627
See application file for complete search history.

(56) References Cited

U.S. PATENT DOCUMENTS 879,335 A * 2/1908 Southmayd ..... 5/627
2,489,828 A * 11/1949 Springer ..... 5/628
5,263,495 A * 11/1993 Butterfield ..... 5/89.1
5,515,549 A * 5/1996 Wang ..... 5/625
5,839,137 A * 11/1998 Butler et al. ..... 5/627
6,128,796 A * 10/2000 McCormick et al. ..... 5/626
6,276,006 B1 * 8/2001 Hoit ..... 5/81.1 R
6,289,534 B1 * 9/2001 Hakamiun et al. ..... 5/89.1
6,851,145 B2 * 2/2005 Smith et al. ..... 5/627
7,168,110 B2 * 1/2007 Girard et al. ..... 5/89.1
7,222,378 B2 * 5/2007 DuPree et al. ..... 5/625
7,624,458 B2 * 12/2009 Felling ..... 5/81.1 T
8,065,765 B2 * 11/2011 Rincon ..... 5/627
2008/0189853 A1 8/2008 Felling

OTHER PUBLICATIONS

A 1 page printout of a website page published by Graham Medical, Copyright 2007 @ http://www.grahammedical.com/Product/Category.aspx?plid=2&catid=66.

* cited by examiner

*Primary Examiner* — Robert G Santos
(74) *Attorney, Agent, or Firm* — T.L. Garrett PLC; Tanya L. Garrett

(57) ABSTRACT

An extraction and transfer sling facilitating lifting of an injured, incapacitated, or person of interest for any reason that may be warranted by emergency services or assistance. The sling has several embodiments each capable of supporting a thigh, buttocks, and back region of a person being lifted. Additionally the sling can include shoulder, head, and leg including foot support for transporting a lifted person from one location to another location.

9 Claims, 13 Drawing Sheets

SLING FOR EXTRACTING AND TRANSPORTING PEOPLE

CROSS-REFERENCE TO RELATED APPLICATIONS

This is a non-provisional utility patent application that claims the benefit of priority from U.S. Provisional Patent Application Ser. No. 61/104,049, filed Oct. 9, 2008, and from U.S. Provisional Patent Application Ser. No. 61/210,799, filed Mar. 23, 2009. The disclosures of each of these applications are hereby incorporated herein by reference in their entireties.

COPYRIGHT SUBJECT MATTER

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

FIELD OF THE INVENTION

The present invention generally relates to device is for immediate evacuation when a person is injured, or passively resistant whether conscious or unconscious for use in the field of transferring a person that needs extracting from a first location to another location in response to emergency situations.

BACKGROUND

Persons of limited mobility, such as paraplegics, quadriplegics, and those suffering from diseases or conditions such as muscular dystrophy, multiple sclerosis, ALS, and cerebral palsy, typically encounter difficulties when faced with a situation where they must be transferred from one location to another, such as from a wheelchair seat to an airfronte seat, a car seat, or a recreational seat (e.g., a kayak or sit ski seat). Additionally, in emergency evacuation situations, it can be difficult to evacuate wheelchair-bound or injured persons from any multi-story building, particularly from skyscrapers or other buildings requiring evacuation down multiple flights of stairs or if in the interests of security, a person needed to be rapidly immobilized and evacuated from an unsecured location to a remote location.

Transfer devices for extracting and transporting such persons from one location to another and emergency evacuation devices currently exist. These transfer devices are typically mechanical lifts and/or slings that require trained operators and heavy mechanical equipment to use. Similarly, such emergency evacuation devices are typically heavy, rigid devices that are difficult to use in emergency situations, particularly by untrained personnel. They are rarely available when needed due to their size and the difficulty in storing such devices. These transfer and emergency evacuation devices also fail to adequately secure the person being transported in the device. Thus, there is a need in the art for a person transfer, immobilizer, and carrier device that is lightweight can be used by unskilled operators or by people who work in public safety such as: police; fireman; tactical; homeland security; EMS units; Military personnel; Private Security Contractors or anyone with the need to easily and quickly lift, move, immobilize, and transport a person whom has fallen, conscious on unconscious, wounded in the line of fire, for a quick evacuation to get someone to safety.

There is a further need in the art for a person lifter and carrier that maintains the person being transported in a stable and immobilized position during use.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

SUMMARY OF THE INVENTION

A sling for Extracting, transporting, and immobilizing people including a plurality of longitudinal straps interconnected with a plurality of lateral support straps, wherein the plurality of longitudinal straps cooperate with the plurality of lateral support straps to support a thigh region, a buttocks region, a back region, and at least one of a shoulder, a head, or a leg region of a lifted person disposed within the sling to facilitate secure transfer of the lifted person disposed within the sling from a first location to a desired second location.

A method of using the sling device is also provided.

BRIEF DESCRIPTION OF THE DRAWINGS

These and other objects, features and advantages of the present invention will become apparent from the following detailed description and the appended drawings in which.

DETAILED DESCRIPTION OF THE INVENTION

Figure 1:
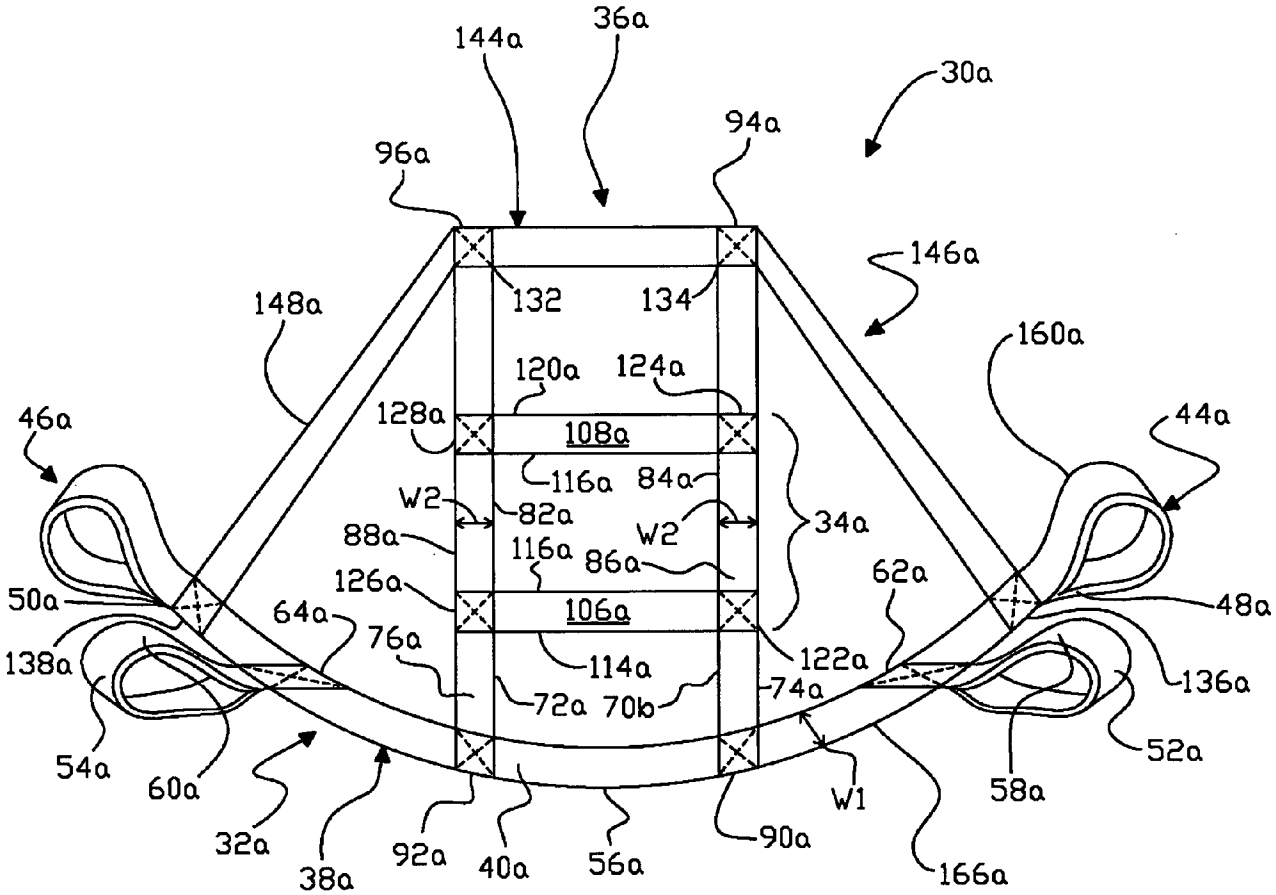
FIG. 1 is a front view of a person extractor, transfer, immobilizer, and carrier sling.

The present invention relates to a handheld sling for the purpose of extracting people from a first location or situation and then lifting people to transport from the first to a second location. The sling provides a safe, quick means of extracting people to safety or assisting in lifting a person. The first situation may be any emergency situation or other situation that requires rapid extraction or removal of people such as civilly disobedient protestors from a first location to a second location.

The handheld sling is a compact device that can be stored in a small carry case or may be disposed in a convenient location of a lifting person's body, wherein a lifting person is any person desiring to use the handheld sling to lift another person disposed or retained within the sling. While a lifting person may be any interested individual, the sling may prove particularly useful to law enforcement officials such as members of the police or SWAT teams. A law enforcement official may transport the handheld sling within an associated leg pouch for instant access to the sling when needed. Additionally, the sling is light-weight, durable and compact thereby allowing for stowage and retrieval to and from small spaces such as in the pocket of a pair of pants such as cargo pants, in the back of a wheelchair, or in a glove box. Existing related devices are cumbersome and not small enough to be able to carry and have in time of emergencies.

Several embodiments of a person extractor, transfer, immobilizer, and carrier sling are provided herein.

The sling is simplistic enough to be used by anyone and can be used for various uses. For the home, lifting an elderly or handicapped person or for tactical uses for SWAT, police or homeland security.

In one embodiment, the sling is used to transport the person from a wheelchair to a travel seat (e.g., an airfronte seat, a bus seat, or a car seat), or from the travel seat to a wheelchair. In one embodiment, the sling is used to transport the person from a recumbent or other position. For example, the sling can be used to transport the person from a seated or reclining position on the floor, ground, bed, recliner, or any other location. In an alternative embodiment, the sling can be used to transport the person in an emergency evacuation situation from a building. In yet another alternative embodiment, the sling is used to transport the person down a flight or a number of flights of stairs. In one embodiment, the sling is used to transport the person in an emergency rescue situation such as a hurricane, tornado, or flood. In one embodiment, the sling is used in conjunction with other ropes, cables, carabiners, and other safety equipment to lift and transport the person.

The sling may be particularly useful for any first responder such as Police, Fireman, Emergency Medical Service personnel, but may also be used in hospitals, airports, assisted Living Homes, or for personal use in the home. In yet another alternative embodiment, the sling is used to transport a person to a kayak, sit ski, or other recreational seat. The sling can be used to transport a person with physical disabilities, an injured person, an elderly person, or any other person who requires assistance or immobilizing.

In an embodiment of the invention, the sling for extracting and transporting people includes:

a plurality of lateral support straps;

at least two elongated longitudinal support straps interconnected with the plurality of lateral support straps to support a thigh region, a buttocks region, and a back region and optionally, at least one of a shoulder, a head, or a leg region of a lifted person disposed within the sling to facilitate secure transfer of the lifted person disposed within the sling from a first location to a desired second location, wherein the sling supports a lifted person disposed within the sling in either a seated or a reclined position while being lifted by at least two lifting persons, wherein the lifting persons are positioned along respective opposing sides of the lifted person disposed within the sling.

In an embodiment of the invention, each of the elongated longitudinal support straps are integrally formed with lateral support straps associated with a plurality of regions adapted to support a desired portion of a person's body including at least two buttocks lateral support straps and at least one lower back lateral support strap.

FIGS. 1-13 illustrate various embodiments of the person extractor, transfer, immobilizer, and carrier sling, hereinafter "sling" 30*a*-30*f* that support and immobilize selected regions of a lifted person's body. As used herein the term extract or variations thereof means to capture and remove a lifted person from a first location by enveloping the sling about the lifted person and disposing the lifted person within the sling. As used herein, the term immobilize means to limit or restrict the movement of selected regions of the lifted person or the entire body of the lifted person.

As shown in respective embodiments in FIGS. 1-2, 3, 4, 5-10, 11, and 12-13, the sling (30*a*-30*f*) supports the lifted person 206 in a seated (FIGS. 1-11) or in reclined position (FIGS. 12-13), while lifted by at least two lifting persons 208.

Figure 6:
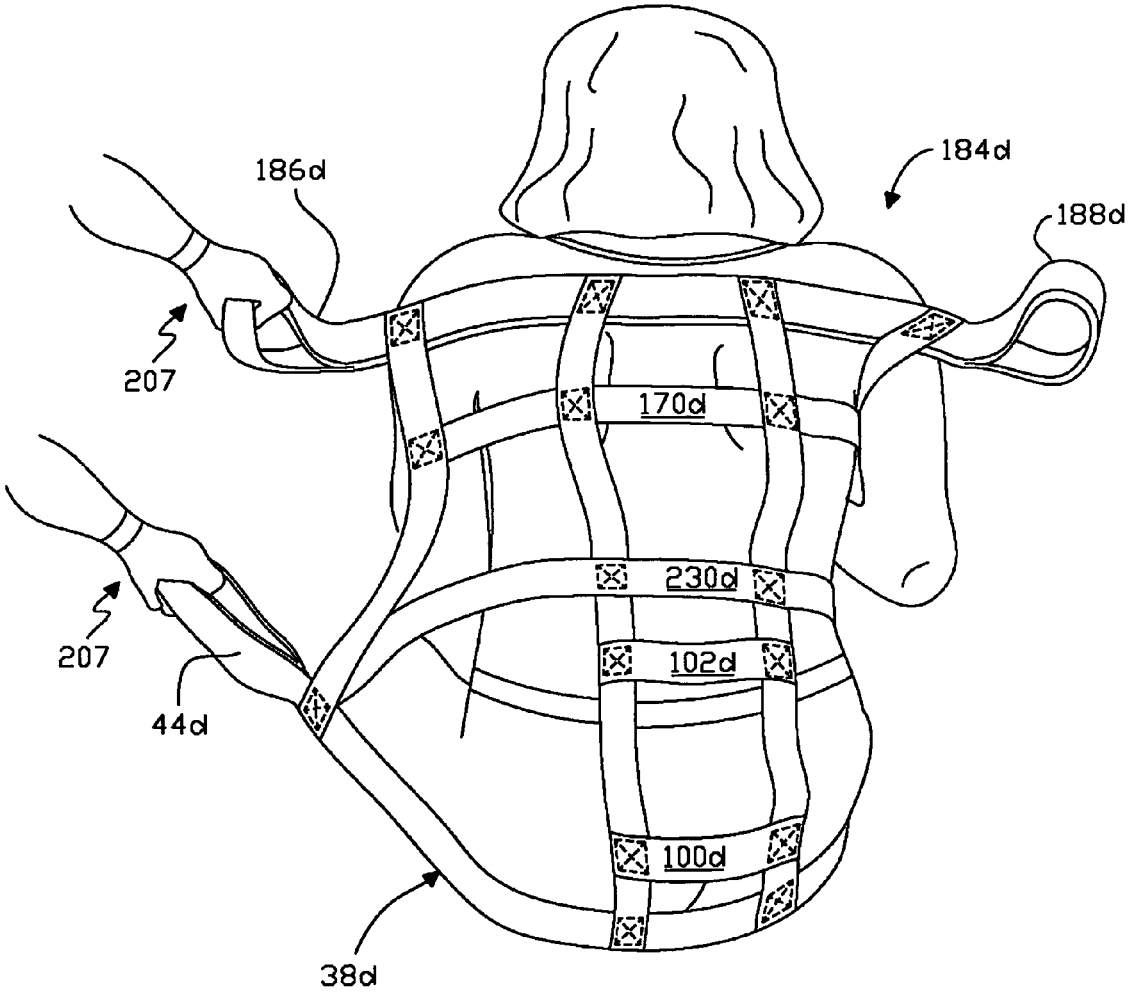
Figure 13:
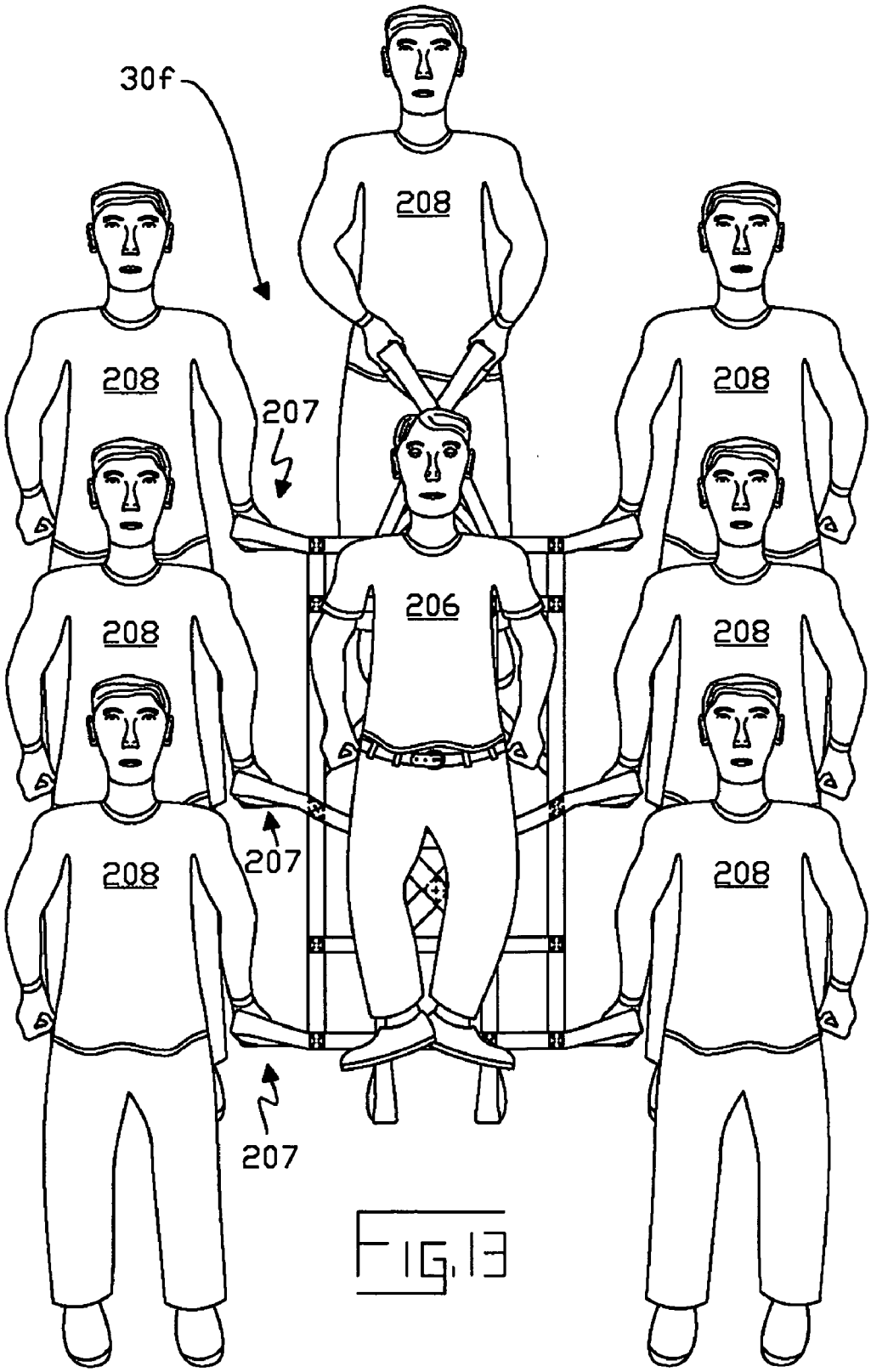
FIG. 13 is a plan in-use view of the sling shown in FIG. 11 including a person disposed atop the sling being transferred by a plurality of lifting people in accordance with an embodiment of the invention.

In the illustrated respective embodiments shown in FIG. 6, the lifting persons 208 are positioned on two opposing sides of the lifted person, but in other embodiments, the lifting persons 208 may be positioned in different locations along at least two opposing sides or along multiple sides of the lifted person (as shown in FIG. 13). In the embodiment shown in FIG. 6, the lifting persons 208 each grasp two associated loops along a same respective opposing side of the lifted person. However, it is contemplated that the same two lifting persons may be oriented about the lifted person such that loops on each opposing side of the lifted person may be grasped by each lifting person. In a non-limiting example, one lifting person may be positioned behind the lifted person to grasp two upper loops and the other lifting person may be positioned in front of the lifted person to grasp two lower loops.

A lifted person 206 is securely disposed or retained within and is supported by the sling. As used herein the terms disposed or retained are used interchangeably to describe a lifted person 206 that is positioned within the sling to be lifted by a lifting person 208 (shown in FIGS. 8, 13). The lifted person 206 (as shown in FIG. 2) has a torso 210 including an upper shoulder region 212, a back region 98, a thigh region 214, and a head region 203.

FIG. 1 is a front view of the sling 30*a* including a thigh support region having a thigh lifting strap 38*a*, a buttocks support region 34*a*, and a back support region 36*a* including a lateral back support strap 130*a* that attaches to the thigh lifting strap 38*a*, wherein the sling 30*a* is shown in an open position thereby allowing the details of the sling to be more easily seen.

Figure 2:
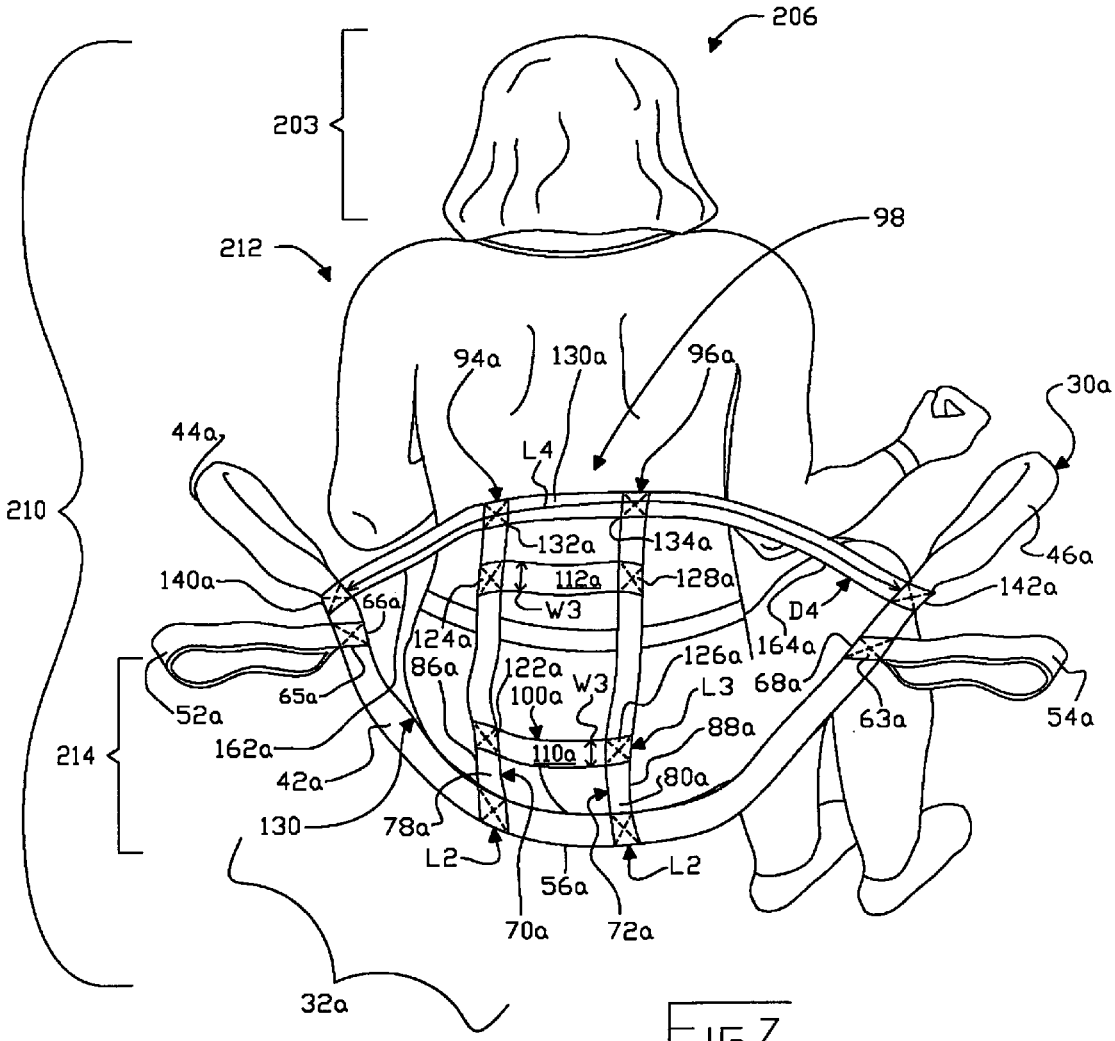
FIG. 2 is a rear in-use view of the sling shown in FIG. 1 with a person positioned in the sling in accordance with one embodiment of the invention.

FIG. 2 is a rear in-use view of the sling shown in FIG. 1 with a lifted person 206 positioned in a personal transfer and carrier sling 38*a* in accordance with one embodiment of the invention.

Figure 3:
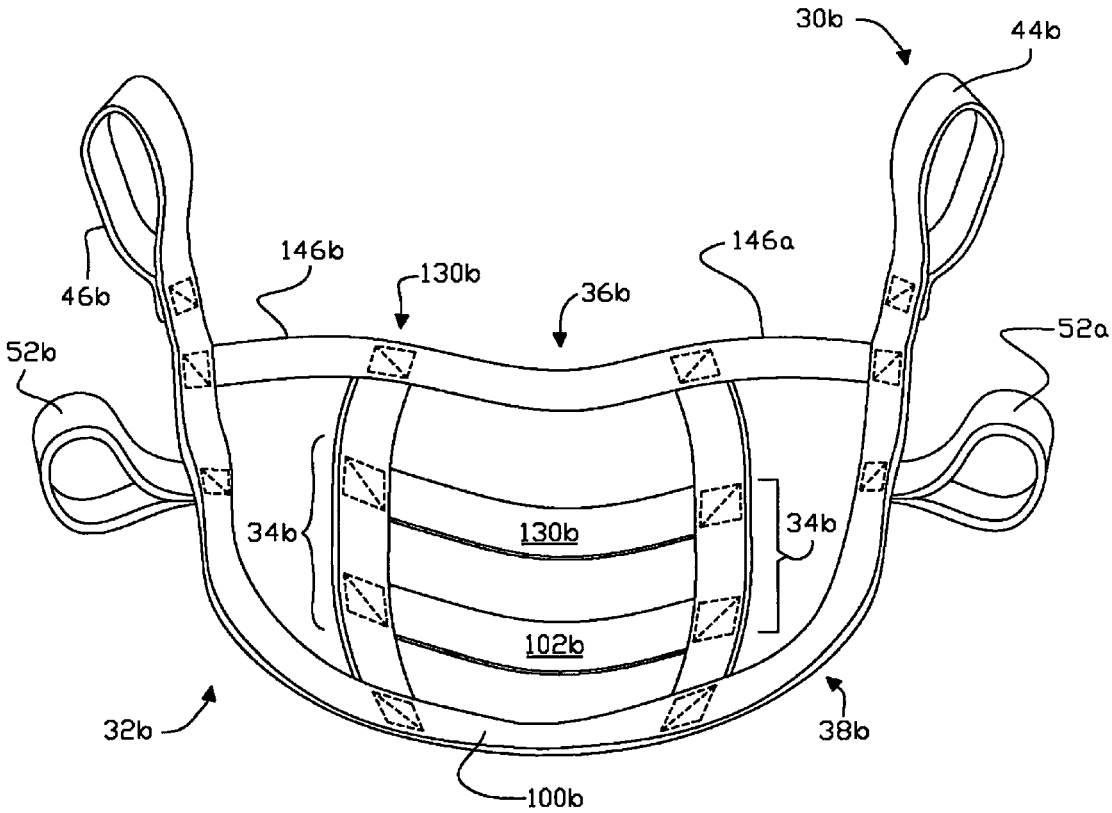
FIG. 3 illustrates a front view of a sling having a lateral back support strap extending between selected portions of a thigh lifting strap in accordance with an embodiment of the invention.

FIG. 3 illustrates a front view of a sling 30*b* similar to the sling 30*a* having a lateral back support strap 130*b* that attaches to a thigh support region 32*b* in two different locations along a thigh lifting strap 38*b* than the lateral back support strap 130*a* of sling 30*a* attaches to thigh lifting strap 38*a*.

As shown in FIGS. 4, and 5-10, the slings 30*c* (FIG. 4) and 30*d* (FIGS. 5-10) each further include a shoulder support region extending upwardly from the back support region.

Figure 11:
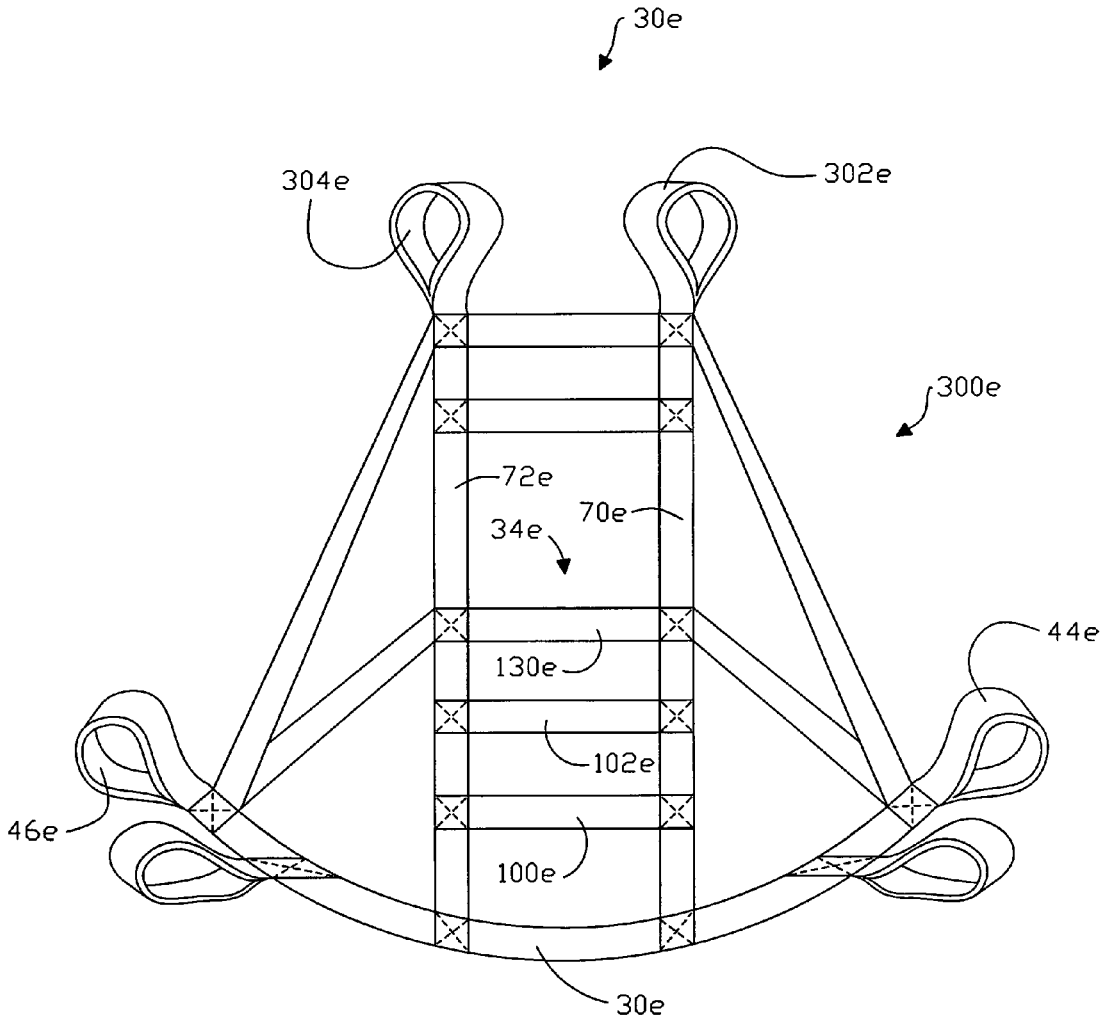
FIG. 11 illustrates a sling including a pair of elongated strap loops extending upwardly from a shoulder support region in accordance with an embodiment of the invention.

As shown in FIG. 11, a sling 30*e* includes a pair of elongated strap loops extending upwardly from a shoulder support region.

Figure 12:
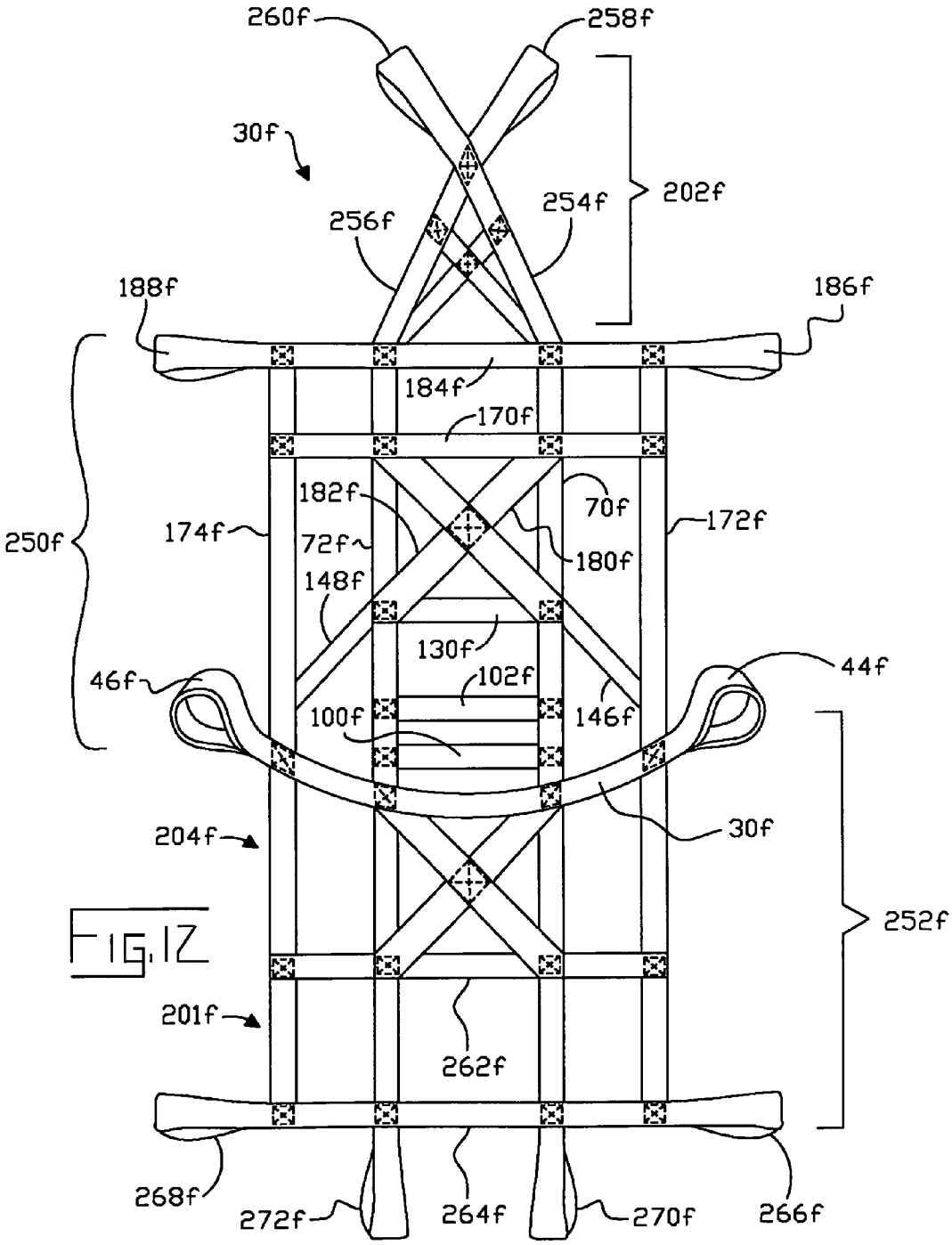
FIG. 12 illustrates a sling a head and leg support including a foot or hand grip support region in accordance with an embodiment of the invention.

As shown in FIGS. 12-13, the sling 30*f* further includes a head support region and a leg support region including a hand grip region.

Each of the support regions forming each of the slings 30*a*-30*f* are formed by interconnected straps that may be of the same or varying widths and may have an associated indicating means such as color or indicia to facilitate use and orientation of each sling in lifting a lifted person 206.

In embodiments of the invention illustrated in FIGS. 1-13, an associated strap forming a respective thigh lifting strap for the thigh support region has a different width and a different color or indicia from each of the straps forming other regions including leg, buttocks, back, shoulder, and head support regions so that the respective thigh support region may be properly oriented to contact the lifted person's thigh region 214. The colors or indicia may vary in accordance with the desired purpose of the lifting persons 208.

In an embodiment of the invention, when each of the slings is used by first responders to an accident scene, the thigh lifting strap may be black and the plurality of straps forming one or more of the leg, buttocks, back, shoulder or head support regions may be orange so that the contrast between the thigh support region and the other regions is immediately apparent.

In another embodiment of the invention, where the sling is used by law enforcement officials to immobilize a person of interest, the coloring of the materials of the sling may be neutral to blend in with a surrounding environment so as to not draw attention to the sling before using the sling to immobilize the person of interest.

The sling may be formed by attaching interconnecting straps via any suitable means of attachment to secure a lifted person 206 therewithin. In an embodiment of the invention, the sling including interconnecting straps may be formed from a solid, continuous, patterned sheet of material that may be cut or stamped out in accordance with a predefined pattern to form integrally formed interconnecting straps.

In several embodiments of the invention shown in FIGS. 1-13, open regions are interposed between each of the straps bounded by a plurality of flexible strap grid patterns defined by each respective leg, thigh, buttocks, back, shoulder, and support region. The open regions in combination with the flexible grid patterns facilitate positioning of the sling around the person and facilitate removal of the sling.

In an embodiment of the invention, the sling may be formed by attaching interconnecting support straps including longitudinal and lateral support straps via any suitable permanent means of attachment thereby integrally forming each of the longitudinal support straps to a respective end of at least one lateral support strap, to an intermediary portion of at least one lateral support strap or to an intermediary portion of a thigh lifting strap.

In an embodiment of the invention, reinforcement of the intersection points may be made by a repetitive stitching pattern such as a box stitch on the overlapping sections, shown in more detail for each FIGS. 1-13, wherein each lateral support strap has two box stitch sections formed at either selected intermediary portions of the respective lateral support strap or at each lateral strap outer end. As shown in FIGS. 1-13 and each embodiment disclosed herein, each respective overlapping sections are reinforced by a box stitch. However, any suitable permanent means of attachment may be used to securely bind and therefore reinforce attachment of overlapping layers of strapping material.

A suitable permanent means of attachment or the process of attaching layers of strapping material as defined herein may include, but is not limited to sewing, rivets, adhesives, clasps, cord, choke holders, pins or any other known means of attaching two or more layers of strapping materials together. Each sling has straps stabilized together at a respective overlapping intersection points to provide structural support and integrity against exterior forces to securely bind the strapping material layers together and to hold the layers together so that the layers form a secure bond while under a predefined weight load.

In an embodiment of the invention, the sling supports a predefined weight load of at least a 400 pound person. In another embodiment the thigh support region has an associated thigh lifting strap that has a tensile strength of 2,030 pounds and additional support straps associated with the leg, buttocks, back, shoulder, and head regions have a tensile strength of 1,180 pounds.

In one embodiment of the invention, all strapping material including, but not limited to straps, strands, and webs used to form the body of the sling may be made from a flexible and durable support material that is resistant to heat and UV radiation as well as snags, wrinkles, and twists. In another embodiment of the invention, the strapping material may be washable in a bleach solution as to a solution of 10 to one from any biohazard material (such as blood).

In one embodiment of the invention, the strapping material may include a treated nylon webbing material, polypropylene fibers or canvas.

In one embodiment, each of the sling straps are made from the same material as the thigh lifting strap. In one embodiment of the invention, the thigh lifting strap has a width dimension that is wider than a dimension of each of the straps forming the buttocks, back, and optionally, at least one of the shoulder, head and leg support regions. In an embodiment of the invention, the thigh lifting strap has a width dimension of three inches and all other sling support straps have a width dimensions of two inches. However, in another embodiment of the invention, the thigh lifting strap and all other support straps forming the sling have equal widths.

The sling does not require the use of fasteners to secure the straps to a person disposed within the sling as the structure of the sling when assembled and used by a person being carried, defined herein as a "lifted person 206", allows for secure engagement of the lifted person's body being lifted or carried by a "lifting person 208".

Additionally, invasive touching of the lifted person 206 disposed within the sling is unnecessary as the lifted person 206 is fully enveloped and immobilized within the sling and thus, there is no need for further direct contact of the lifted person's body.

In one embodiment, the sling includes a plurality of support straps that reinforces selected regions of or all of the sling and further includes loops forming handles or hand grips for grasping by a lifting person's hand. The handles or hand grips are sized to allow a lifting person 208 to fit all or a portion of the lifting person's hand 207 through the loop. The loops allow a lifting person to fit all or a portion of the lifting person's hand through the thigh lifting handle thereby allowing lifting of the lifted person without invasive touching of the lifted person.

In other embodiments, the support straps and loops are formed from any material that may adequately support the weight of the person being lifted without breaking or compromising the structure or integrity of any portion of the sling.

Additionally, each sling structure also allows the lifted person 206 to wear or be disposed within the sling while in either a reclined or a seated position with a reduced risk of injury.

As used herein, like elements will be referred to with like reference numbers throughout. The various embodiments of the sling 30*a*-30*e* have similarly referenced elements having same reference number prefix but include different suffices "a"-"e" to respectively associate like elements of different embodiments having a similar function with an embodiment with the same suffix. For example the thigh lifting strap 38*a* shown in FIGS. 1-2 associated with sling 30*a* performs essentially the same function as thigh lifting straps with the same prefix "38", i.e. 38*b*-38*f* associated with slings 30*b*-*f* shown in FIGS. 3 (38*b* having same suffix "b" as sling 30*b*), 4 (38*c* having same suffix "c" as sling 30*c*), 5-10 (38*d* having same suffix "d" as sling 30*d*), 11 (38*e* having same suffix "e" as sling 30*e*), and 12-13 (38*f* having same suffix "f" as sling 30*f*), respectively.

As shown in FIGS. 1-2, the sling 30*a* includes a thigh support region 32*a*, a buttocks support region 34*a* (shown in FIG. 1) extending upwardly when worn by a lifted person 206 from the thigh support region 32*a*, and a back support region 36*a* (shown in FIG. 1) extending upwardly from the buttocks support region 34*a*.

Additionally, at least two elongated longitudinal support straps are integrally formed with lateral support straps associated with a plurality of regions adapted to support a desired portion of a person's body including at least two of buttocks lateral support straps and at least one lateral back support strap.

As shown in FIGS. 1-2, the sling 30*a* includes a thigh support region 32*a*, a buttocks support region 34*a* (shown in FIG. 1) extending upwardly when worn by a lifted person 206 from the thigh support region 32*a*, and a back support region 36*a* (shown in FIG. 1) extending upwardly from the buttocks support region 34*a*.

The thigh support region including a thigh lifting strap including two opposing thigh lifting strap first and second ends and adapted to be positioned symmetrically underneath the lifted person's buttocks at an upper portion of the lifted person's thigh to support the lifted person's thigh region.

In the illustrated embodiment shown in FIGS. 1-2, thigh lifting strap 38*a* (shown in FIG. 1) includes a thigh strap interior surface 40*a* (shown in FIG. 1) facing inwardly towards a person being retained within the sling 30*a*, a thigh strap exterior surface 42*a* (shown in FIG. 2) facing outwardly from the lifted person 206 disposed within the sling 30*a*, and two first thigh loops, 44*a*, 46*a*, the thigh lifting strap 38*a* adapted to be positioned symmetrically underneath person's buttocks at an upper portion of a person's thigh. The thigh lifting strap 38*a* has an associated width dimension W1.

In an embodiment of the invention, the two opposing thigh lifting strap first and second ends 48*a*, 50*a* (shown in FIG. 1) are separated by a distance L1 and are integrally formed with the thigh lifting strap to form the two first thigh loops 44*a*, 46*a* and are further integrally formed with the two second thigh loops 52*a*, 54*a* located a predefined distance inbound from a respective inner edge of an associated one of the elongated longitudinal support straps towards a longitudinal center 56*a* of the thigh lifting strap 38*a* longitudinally along the thigh lifting strap 38*a*. The predefined distance may vary to form a sling that accommodates lifted persons 206 of various sizes.

In an embodiment of the invention, each of the second thigh loops 52*a*, 54*a* are formed from a respective second thigh loop strap 58*a*, 60*a* (shown in FIG. 1) each having an associated first end 62*a*, 64*a* (shown in FIG. 1) attached to the interior surface 40*a* (shown in FIG. 1) of the thigh lifting strap 38*a* and an associated second end 66*a*, 68*a* (shown in FIG. 2) attached to the exterior surface 42*a* of the thigh lifting strap 38*a* thereby "sandwiching" the thigh lifting strap 38*a* in-between each of the respective first and second ends 62*a*, 64*a*, 66*a*, 68*a* of the second thigh loop strap.

Each of the first and second thigh loops 44*a*, 46*a*, 52*a*, 54*a* form respective first and second thigh lifting handles or hand grips sized to allow a lifting person 208 to fit all or a portion of the lifting person's hand 207 (shown in FIGS. 6-8, 13) through the thigh lifting handle. Each of the first and second thigh lifting handles may include an opening, slit or hole in the thigh lifting strap 38*a*.

In an embodiment of the invention illustrated in FIGS. 1-2, at least two elongated longitudinal support straps 70*a*, 72*a* are attached to a respective one of the two lateral buttocks support straps 100*a*, 102*a* and to at least one back lateral support strap 130*a* by attaching each of the elongated longitudinal support straps 70*a*, 72*a* to the lateral straps 100*a*, 102*a*, 130*a* at the respective overlapping intersection or connection points at respective predefined distances along each of the two elongated longitudinal support straps to form a two layer intersection point.

Each of the two elongated longitudinal support straps including a first and a second longitudinal support strap 70*a*, 70*b* include an elongated interior surface 74*a*, 76*a* (shown in FIG. 1) facing inwardly towards a lifted person 206 disposed within the sling 30*a*, an elongated exterior surface 78*a*, 80*a* (shown in FIG. 2) facing outwardly from a lifted person 206 disposed within the sling 30*a*, each having: an associated width W2 between respective inner (82*a*, 84*a* shown in FIG. 1) and outer (86*a*, 88*a*) respective first and a second longitudinal support strap edge, and an associated length L2 defined by a distance between opposing respective first and second longitudinal straps 70*a*, 72*a* (shown in FIG. 2) first and second ends 90*a*, 92*a*, 94*a*, 96*a*, respectively (shown in FIG. 1), wherein the first ends 90*a*, 92*a* of each of the elongated longitudinal support straps 70*a*, 72*a* are integrally formed with the thigh lifting strap 38*a*, and are spaced apart from each other such that the inner edges (82*a*, 84*a*) of each respective elongated longitudinal support strap 70*a*, 72*a* are substantially equidistant from a longitudinal center 56*a* of the thigh lifting strap 38*a*.

In an embodiment of the invention, illustrated in FIGS. 1-3, the length L2 of the elongated longitudinal support straps 70*a*, 72*a* is equal to or greater than ten inches.

In another embodiments of the invention, illustrated in FIGS. 4-10, the length of the elongated longitudinal support straps extending upwardly from the thigh lifting strap each have a length greater than L2 shown in FIGS. 1-2.

In an embodiment of the invention, each of the first ends of the elongated longitudinal support strap 70*a*, 70*b* are integrally formed with the thigh lifting strap 38*a*, and are symmetrically centered about the longitudinal center 56*a* of the thigh lifting strap 38*a* such that the distance between each respective first and second longitudinal strap inner edge 82*a*, 84*a* and the longitudinal center of the thigh lifting strap 38*a* is three inches.

In an embodiment of the invention shown in FIGS. 1-2, each of the elongated longitudinal support straps extend upwardly, when worn by a person, from a respective first end 90*a*, 92*a* (shown in FIG. 1) associated with a respective elongated longitudinal support strap 70*a*, 72*a* integrally formed with the thigh lifting strap 38*a* to a mid-region of a person's back 98 (shown in FIG. 2), thereby terminating at a respective elongated longitudinal first and second support strap second end 94*a*, 96*a*.

In an embodiment of the invention shown in FIGS. 1-2, the buttocks support region 34*a* includes at least two lateral first and second buttocks support straps 100*a*, 102*a* (shown in FIG. 2), the buttocks support region 34*a* extending upwardly along the at least two elongated longitudinal straps 70*a*, 72*a* from the thigh support region 32*a* when the sling 30*a* is positioned such that the thigh support region 32*a* is oriented below the buttocks support region 34*a*.

Each of the lateral buttocks support straps 100*a*, 102*a* include a lateral interior surface 106*a*, 108*a* (shown in FIG. 1) facing inwardly towards a person being retained within the sling, a lateral exterior surface 110*a*, 112*a* (shown in FIG. 2) facing outwardly from a person being retained within the sling 30*a*, an associated width W3 extending between a respective first and second associated upper 118*a*, 120*a* (shown in FIG. 1) and lower 114*a*, 116*a* edges, and a lateral length L3 (shown in FIG. 2) extending between respective first and second associated first and second outer edges integrally formed with each respective first and second elongated longitudinal support straps 70*a*, 72*a*.

The at least two buttocks straps 100*a*, 102*a* form a buttocks support region 34*a* (shown in FIG. 1) that configures the lateral buttocks support straps 100*a*, 102*a* along with respective intersection or connection points along the elongated longitudinal straps to support the buttocks region 131 (shown in FIG. 2) of the lifted person.

In an embodiment of the invention, as shown in FIGS. 1-2, the lateral buttocks support straps and elongated longitudinal straps are coupled to each other at predefined intersection points 122*a*, 124*a*, 126*a*, 128*a* and are spaced a distance apart to form a buttocks support grid defining the buttocks support region 34*a* to accommodate buttocks of varying widths.

In one embodiment, the lateral buttocks support straps 100*a*, 102*a* each have a length L3 of about six inches.

As shown in an embodiment in FIGS. 1-2, the back support region 36*a* is configured to support a lifted person's 206 back while being lifted, carried, immobilized, or transferred and extends upwardly extending upwardly along the at least two elongated longitudinal straps 70*a*, 72*a* from the buttocks support region 34*a* and includes at least one lateral back support strap 130*a* extending laterally between the at least two elongated longitudinal support straps 70*a*, 72*a*.

The at least one lateral back support strap 130*a* (shown in FIG. 2) is spaced apart from the at least two buttocks support straps 100*a*, 102*a* and has associated intersecting elongated longitudinal strap intersection points 132*a*, 134*a* (shown in FIG. 2) located on the back support region 36*a* and intersecting thigh strap points 136*a*, 138*a* (shown in FIG. 1) located along the thigh lifting strap 38*a* a predefined distance D4 from the respective first and second elongated longitudinal strap outer edges 86*a*, 88*a*.

The lateral back support strap 130*a* has an intermediary region integrally attaching to respective portions of the elongated longitudinal straps 70*a*, 72*a* and two terminal ends, a first and a second lateral back support strap terminal end 140*a*, 142*a* (shown in FIG. 2) each integrally formed with the thigh lifting strap 38*a* at a distance D4 from the first and second elongated longitudinal strap outer edges 86*a*, 88*a*. The at least one lateral back support strap 130*a* has an associated length L4 between each of the first and a second lateral back strap support terminal ends 140, 142*a* (shown in FIG. 2).

In an embodiment of the invention, the predefined distance D4 is 9.5 inches.

The at least one back support strap 130*a* includes a lateral section 144*a* (shown in FIG. 1) extending between the two elongated longitudinal support straps 70*a* (shown in FIG. 2), 72*a* (shown in FIG. 1) and two angled sections 146*a*, 148*a* (shown in FIG. 1) extending outwardly from the lateral section, each of the two angled sections terminating at a respective lateral back support strap first and second end, wherein each lateral back support strap first and second end attaches to at least two predefined overlapping intersection points along the thigh lifting strap disposed between a respective outer edge of a respective one of the two elongated longitudinal straps and a respective first or second end of the thigh lifting strap that each respectively extend from a respective one of the elongated longitudinal strap outer edges located at a respective overlapping intersection points with the at least one back support strap.

The two angled sections terminate in the respective back support strap first and second ends 140*a*, 142*a* that each respectively extend from a respective one of the elongated longitudinal strap outer edges 86*a*, 88*a* located at overlapping intersection points 132*a*, 134*a* of the at least one back support strap 130*a* with a respective one of the elongated longitudinal support straps 70*a*, 72*a* to attach to a predefined overlapping intersection point 136*a*, 138*a* of the thigh lifting strap 38*a* disposed between a respective outer edge 86*a*, 88*a* of a respective one of the two elongated longitudinal straps 70*a*, 72*a* and a respective closest first or second end 48*a*, 50*a* of the thigh lifting strap 38*a*.

In an embodiment of the invention, each second thigh loop 52*a*, 54*a* is formed between respective first and second ends 140*a*, 142*a* of the at least one back support strap 130*a* attached to the predefined overlapping intersection points 63*a*, 65*a* of the thigh lifting strap 38*a* disposed between a respective outer edge 86*a*, 88*a* of a respective one of the two elongated longitudinal support straps 70*a*, 72*a* to a respective closest first or second end of the thigh lifting strap.

In an embodiment of the invention, each second thigh lifting loop 52*a*, 54*a* is angled with respect to a top edge 160*a* (shown in FIG. 1) of the thigh lifting strap 38*a* and is spaced a predefined distance from a respective inner edge 162*a*, 164*a* (shown in FIG. 2) of the associated at least one back support strap 130*a* to a lower edge 166*a*(shown in FIG. 1) of the thigh lifting strap 38*a* at a point where the respective inner edge 162*a*, 164*a* of the associated at least one back support strap 130*a* intersects with the lower edge 166*a* of the thigh lifting strap 38*a*.

In an embodiment of the invention, the predefined distance from a respective one of the inner edges 162*a*, 164*a* of the back strap support 130*a* is four inches.

In an embodiment of the invention, each opposing first thigh loops 44*a*, 46*a* are formed by extending a respective first and second thigh strap ends 48*a*, 50*a* over a respective one of the respective first and second ends 140*a*, 142*a* of one of the at least one back support angled sections 146*a*, 148*a* to form a three layer overlapping structure having respective back support first and second ends 140*a*, 142*a* "sandwiched" between an end 48*a*, 50*a* of a respective first thigh loop 44*a*, 46*a* and a portion of the thigh strap overlapped by a respective lateral back support strap first and second end.

In another embodiment illustrated in FIG. 3 an alternative sling 30*b*, similar to sling 30*a* is shown. Each of the elements of the sling 30*b* are the same and are formed the same as the elements shown in FIGS. 1-2, except for the back support strap 130*b* shown in FIG. 3 has laterally formed sections 146*b*, 148*b* that each respectively attach to the thigh lifting strap 38*b* of the sling 30*b* in between respective first thigh loops 44*b*, 46*b* and respective second thigh loops 52*b*, 54*b*. The at least two buttocks straps 100*b*, 102*b* form a buttocks support region 34*b* (shown in FIG. 3) that configures the lateral buttocks support straps 100*b*, 102*b* along with respective intersection or connection points along the elongated longitudinal straps to support the buttocks region of the person.

In the embodiments shown in FIGS. 4-13, the sling includes the thigh support region, the buttocks support region, and the back support region as described with respect to FIGS. 1-3 and further includes at least one of a shoulder support region that supports a shoulder region of a lifted person (FIGS. 4-11), a head support region that supports a head region of a lifted person (FIGS. 12-13), and a leg support region that supports a leg and foot region of a lifted person disposed within the sling (FIGS. 12-13).

FIG. 3 illustrates a front view of a sling 30*b* similar to the sling 30*a* having a thigh support region 32*b*, a buttocks support region 34*b* extending upwardly when worn by a lifted person 206 from the thigh support region 32*b*, and a back support region 36*b* extending upwardly from the buttocks support region 34*b*.

In particular, the back support region 36*b* extends upwardly along the at least two elongated longitudinal support straps from the thigh support region 32*b* when the sling 30*b* is positioned such that the thigh support region 32*a* is oriented below the buttocks support region 34*b*.

The back support region is formed by a lateral back support strap 130*b* extending between selected portions of a thigh lifting strap and attaching to the thigh lifting strap in-between a respective first (44*b*, 46*b*) and a respective second thigh loop (52*b*, 54*b*).

Figure 4:
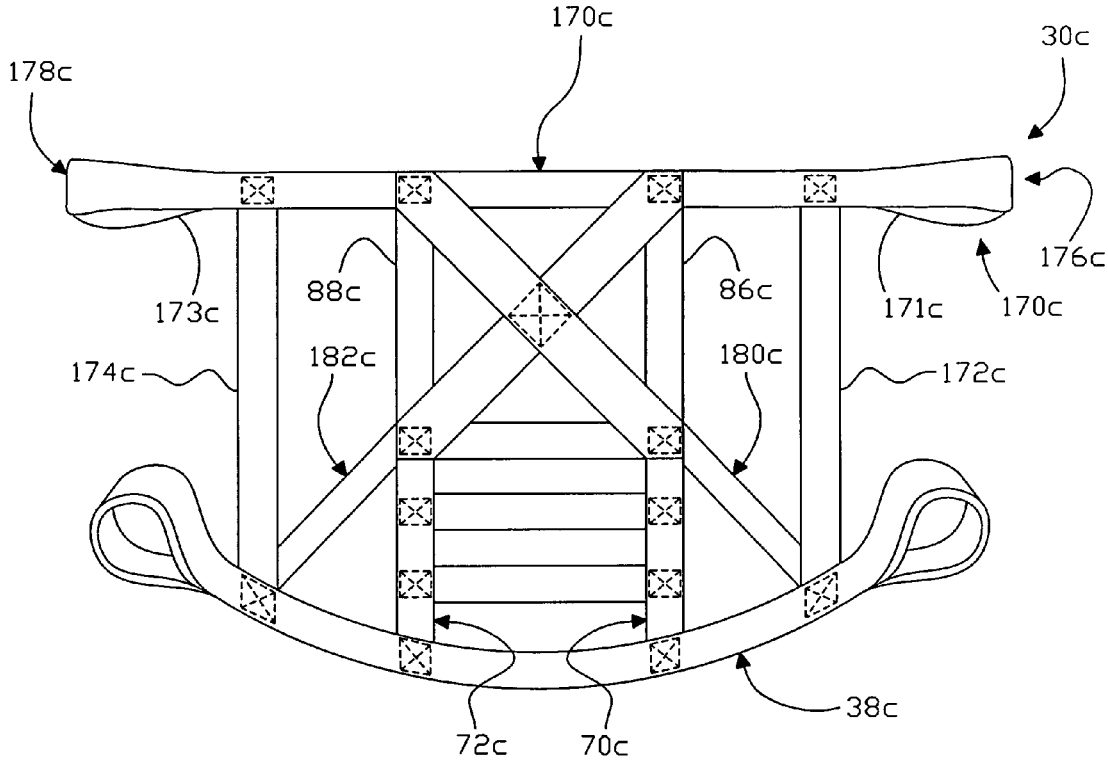
FIG. 4 illustrates a front view of a sling including a shoulder support region extending upwardly from a back support region in accordance with an embodiment of the invention.

As shown in FIG. 4, an embodiment of a sling 30*c* is shown and includes at least one first lateral shoulder support strap 170*c* that terminates in respected outer ends 171*c*, 173*c*, wherein two respective first lateral shoulder strap loops 176*c*, 178*c* are formed at each respective opposing outer ends of the first lateral support strap 170*c*. The first lateral shoulder support strap 170*c* is integrally formed across each of the two elongated longitudinal support straps 70*c*, 72*c* and extends laterally a predefined distance from outer edges 86*c*, 88*c*, of the two elongated longitudinal support straps 70*c*, 72*c* and terminates at first lateral shoulder strap loops 176*c*, 178*c*. A third and a fourth respective elongated longitudinal support strap 172*c*, 174*c* is formed between first lateral shoulder support strap 170*c* and thigh lifting strap 38*c* and has first ends integrally formed with the thigh lifting strap 38*c* at predefined intersecting points. In an embodiment of the invention, the third elongated lifting strap 172*c* attaches to the thigh lifting strap 38*c* between the first elongated longitudinal support strap 70*c* and a first terminal end of the thigh lifting strap defined by first thigh loop 44*d*, and wherein the fourth elongated lifting strap 174*c* attaches to the thigh lifting strap 38*c* between the second elongated longitudinal support strap 72*c* and a second terminal end of the thigh lifting strap defined by first thigh loop 46*d*.

Additional cross-bracing is formed by at least two cross-brace members 180*c*, 182*c* extending within the shoulder region or between the at least one lateral shoulder support strap 170*c* and the thigh lifting strap 38*c* that lend added support for a lifted person 206 disposed within sling 30*c*.

As shown in FIGS. 5-10 an embodiment a sling 30*d* having the thigh lifting strap 38*d*, the back support region 34*d* disclosed with respect to the sling 30*d* and further includes a shoulder region having a first and a second lateral shoulder support strap 170*d*, 184*d*.

As shown in FIGS. 5-10, the sling 30*d* includes a lower sling structure having the same features and formed in the same manner as sling 30*a* shown in FIGS. 1-2, wherein sling 30*d* further includes a shoulder support region 180*d* (shown in FIG. 5) extending upwardly along the at least two first and second elongated longitudinal support straps 70*d*, 72*d* from the back support region 34*d* when the sling 30*d* is oriented such that the shoulder support region 180*d* is above the thigh lifting strap 38*d*.

In an embodiment of the invention shown in FIGS. 5-10, the sling 30*d* further includes comprising a second lateral shoulder strap 184*d* wherein the first and the second lateral shoulder straps 170*d*, 184*d* extend across the four elongated longitudinal straps 70*d*, 72*d*, 172*d*, 174*d* thereby supporting the shoulder region 180*d*.

In the embodiment of the invention shown in FIGS. 5-10, the third and fourth elongated longitudinal straps 172*d*, 174*d* each extend longitudinally upwards from the thigh lifting strap 38*d* across the first lateral shoulder strap 170*d* and each terminate at the second lateral shoulder strap 184*d*. The second lateral shoulder straps 184*d* extends across the four elongated longitudinal straps 70*d*, 72*d*, 172*d*, 174*d* (shown in FIG. 5). The first and a second elongated longitudinal support straps 70*d*, 72*d* formed in a similar manner to first and second longitudinal elongated support straps 70*a*, 70*b* disclosed with respect to FIGS. 1-2, further extending from the at least one lateral back support strap 130*d* across first shoulder strap 170*d* to the second lateral shoulder strap 184*d*, thereby supporting the shoulder region 180*d*.

The straps 70*d*, 72*d* extend longitudinally upwardly from the thigh lifting strap as described with reference to the sling 30*a* shown in FIGS. 1-2, and from the back support region 34*d*. The sling 30*d* further extends from the buttocks and back regions to a shoulder region 180*d* and thereby terminating at a respective first or second elongated longitudinal support strap second end. Each of the elongated longitudinal support straps are integrally formed with an associated lateral support strap associated with a plurality of regions adapted to support a desired portion of a person's body including a plurality of buttocks lateral support straps, at least one back lateral support strap, a first and a second lateral shoulder support strap 170*d*, 184*d*.

In an embodiment of the invention shown in FIGS. 5-10, first and second lateral shoulder straps 170*d*, 184*d* are centered longitudinally about the at least two elongated longitudinal support straps 70*d*, 72*d* in a similar manner as described with respect to FIGS. 1-2. In an embodiment of the invention shown in FIGS. 5-10, the first lateral shoulder support strap 170*d* terminates in respected outer ends 171*d*, 173*d* (shown in FIG. 5) and do not include first and second first shoulder strap loops 176*c*, 178*c* as disclosed with respect to FIG. 4.

In an embodiment of the invention, first shoulder strap loops 186*d*, 188*d* may be formed on opposing outer ends 171*d*, 173*d*. In the embodiment of the invention shown in FIG. 5, the second shoulder support strap 186*d* is spaced apart from the lateral back support strap 130*d* and from the first lateral shoulder strap 170*d* and includes opposing second shoulder strap first and second ends that terminate in opposing second shoulder strap first and second ends folded over to form second shoulder strap loops 186*d*, 188*d*.

In an embodiment of the invention shown in FIGS. 5-10, third and fourth elongated longitudinal straps 172*d*, 174*d* attach to the first and second lateral shoulder straps 170*d*, 184*d* and attach to the thigh lifting strap 38*d* as described with respect to the attachment of the straps 72*c*, 74*c* in reference to FIG. 4. The third and fourth elongated straps 172*d*, 174*d* additionally support side regions of the lifted persons 206 body.

In an embodiment of the invention, the second lateral shoulder strap 184*d* is also centered about the at least two first and second elongated longitudinal support straps 70*d*, 72*d* and is spaced apart from the first lateral shoulder support strap and has associated intersecting elongated longitudinal strap portions located on the shoulder support region 180*d* to form a grid pattern of and intersecting thigh strap portions located along the thigh lifting strap a predefined distance from the respective first and second elongated longitudinal strap outer edges.

The lateral back support strap has an intermediary region attaching to respective portions of the elongated longitudinal straps and two terminal ends, a first and a second lateral back strap support terminal end each integrally formed with the thigh lifting strap at a distance D4 from the first and second elongated longitudinal strap outer edges. The lateral back support strap has an associated length L4 between each of the first and a second lateral back strap support terminal ends.

Figure 5:
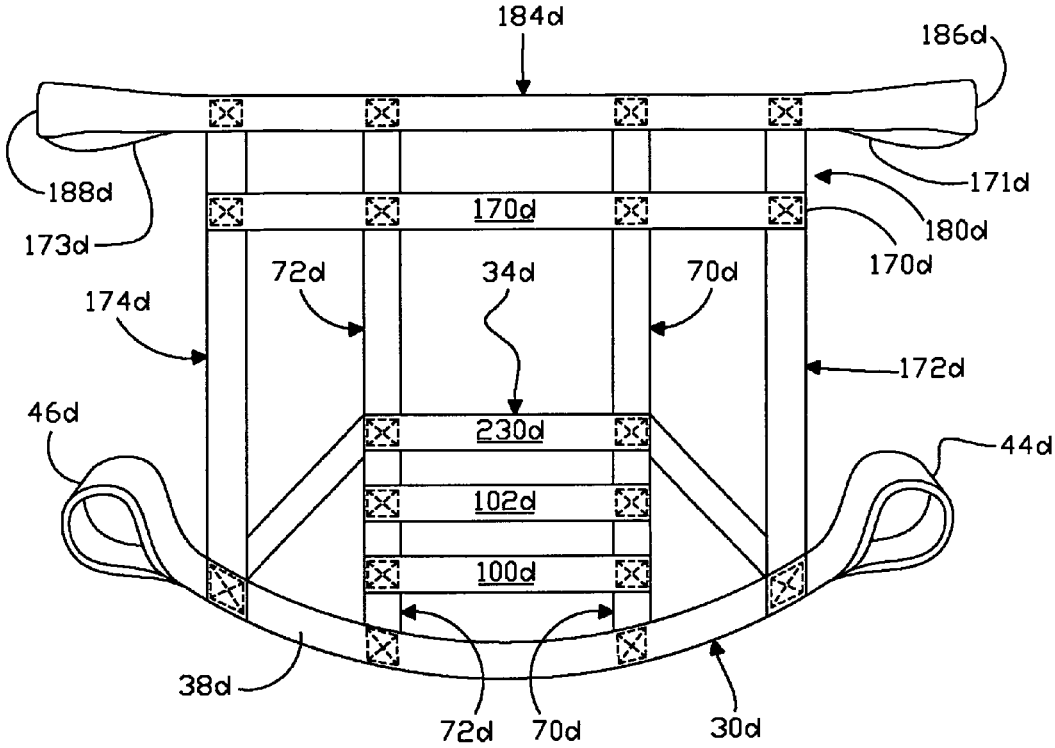
FIGS. 5-10 illustrates several views of a sling including a shoulder support region extending upwardly from a back support region in accordance with an embodiment of the invention.

FIG. 6 illustrates a rear in-use view of a person positioned in the sling 30*d* shown in FIG. 5.

Figure 7:
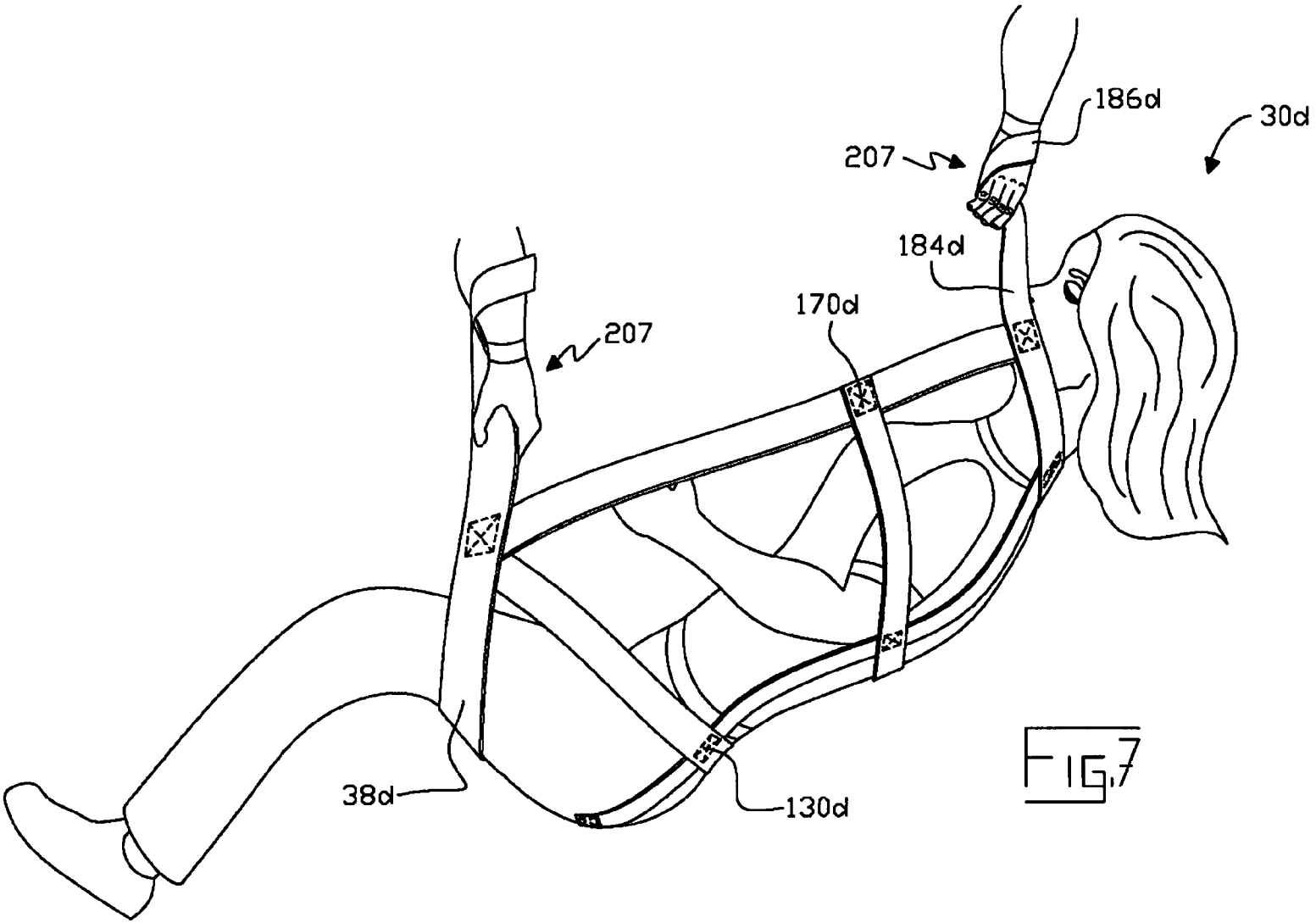

FIG. 7 illustrates a side perspective in-use view of the sling 30*d* shown in FIG. 6.

Figure 8:
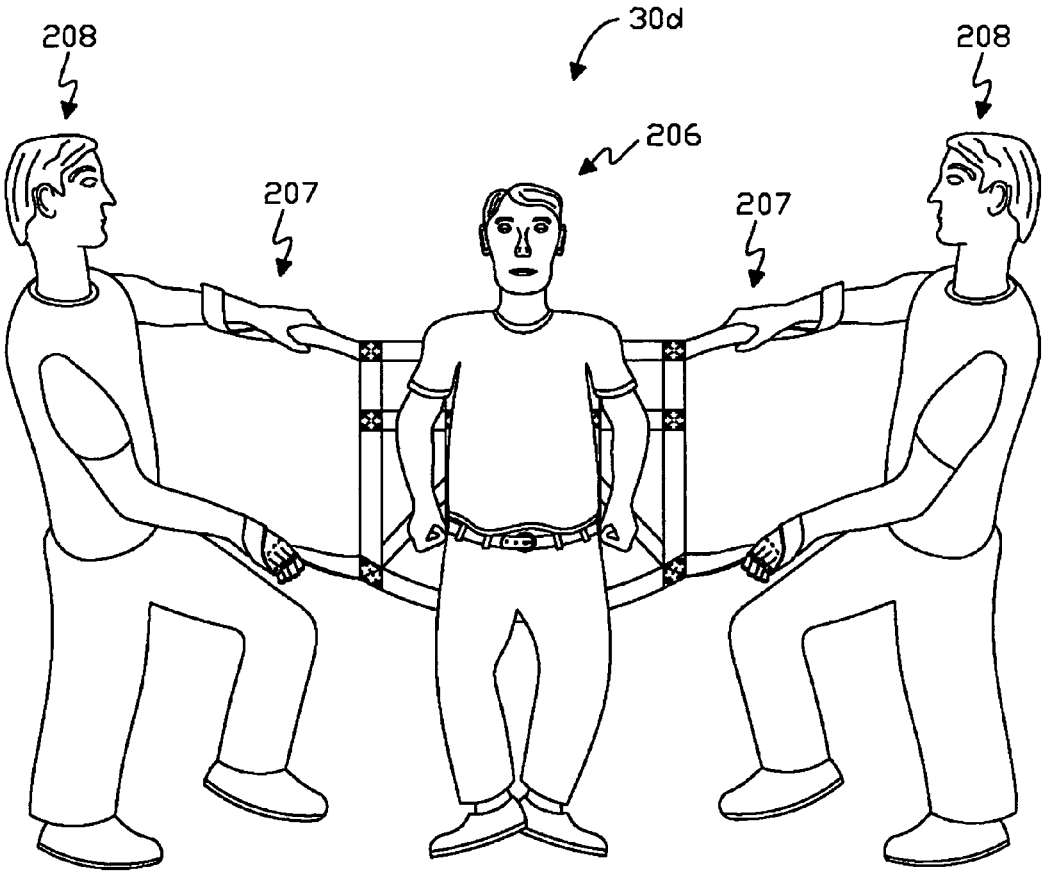

FIG. 8 illustrates use of the second lateral support strap loops 186*d*, 188*d* by two lifting persons 208.

Figure 9:
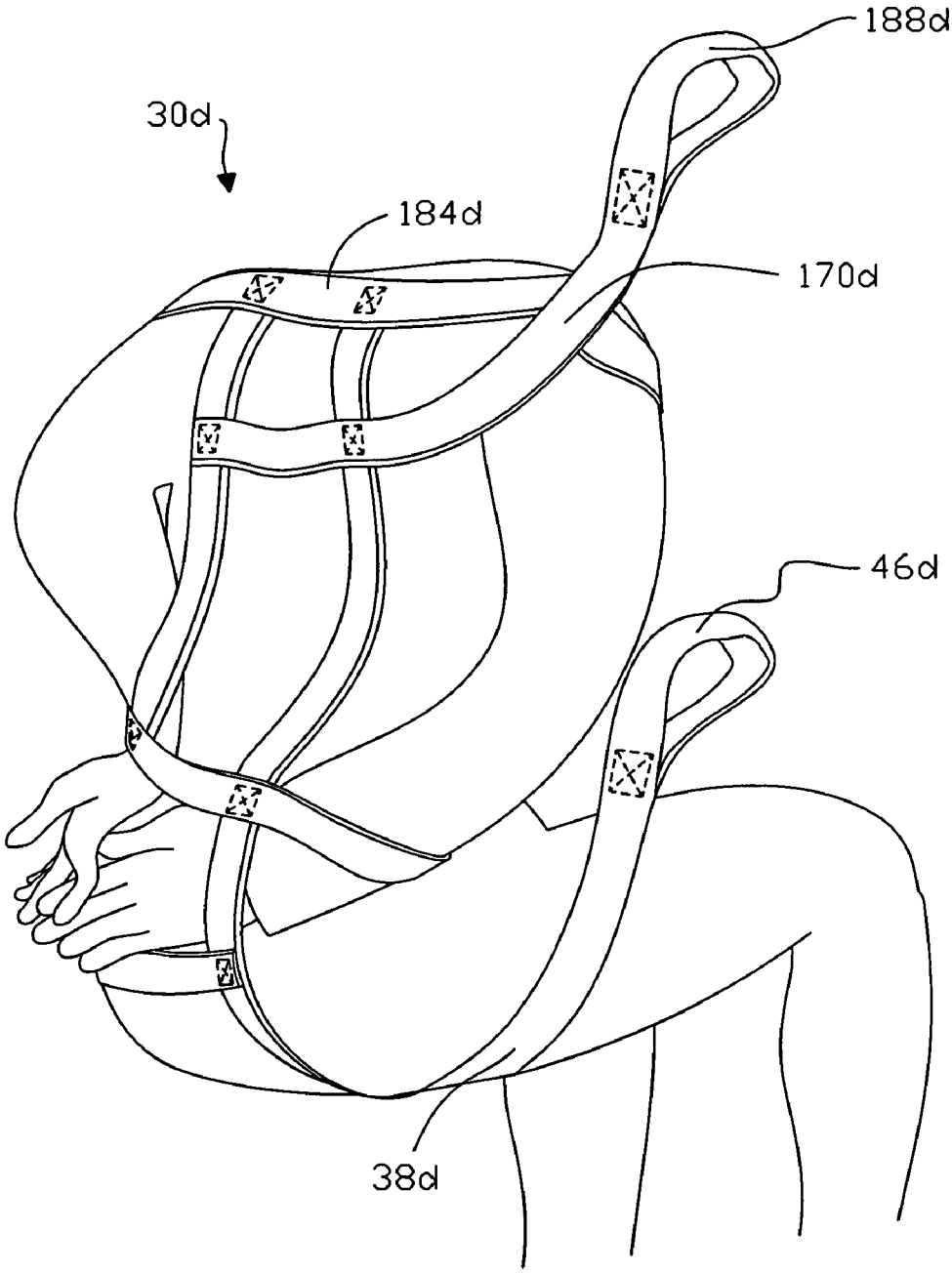

FIG. 9 illustrates a side perspective view of a lifted person 206 secured in sling 30*d* having hands immobilized between the back and buttocks support region. The lifted person's arms are supported by the strap 130*d* as illustrated in FIG. 10 and are thus able to rest comfortably thereon.

Figure 10:
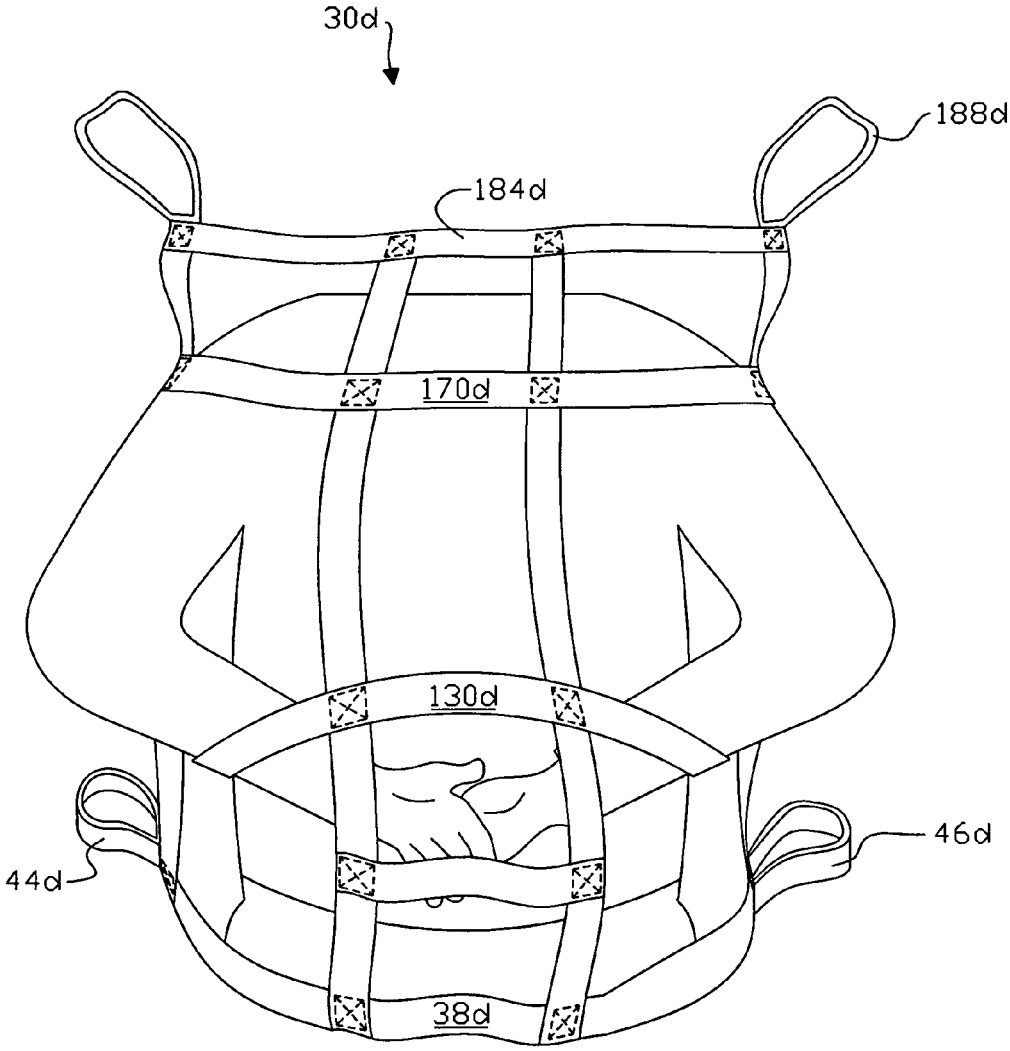

FIG. 10 illustrates a rear view of the person secured in the sling 30*d* as shown in FIG. 9.

FIG. 11 illustrates a front view of a sling 30*e* similar to the sling 30*d* illustrated in FIGS. 5-10 forming the lower support structure 30*a* as disclosed with respect to FIGS. 1-2 and further including a modified upper structure 300*e* including two elongated longitudinal support straps 70*e*, 72*e* terminating in support loops 302*e*, 304*e*. In the embodiment illustrated in FIG. 11, the sling includes upper handle loops 302*e*, 304*e*. In another embodiment, handle loops may be located anywhere on the outer portions of the sling and can be integral with or separate from one or more of the longitudinal or lateral support straps.

In the embodiment shown in FIGS. 12-13, the sling 30*f* includes a first sling structure 250*f* having the two lateral shoulder strap 170*f*, 184 similar to shoulder straps 170*d*, 184*d* shown in FIGS. 5-10 and cross bracing members 180*f*, 182*f* similar to members 180*c*, 182*c* shown in FIG. 4. Additionally, the sling 30*f* includes a head support region 202*f* (shown in FIG. 12) and second sling support structure 252*f* defining a leg region 204*f* including a foot support region 201*f*.

In the illustrated embodiment in FIG. 12, the first sling structure 250*f* includes first and second cross bracing members 254*f*, 256*f* extending cross-wise outwardly from the first and second elongated longitudinal straps 70*f*, 72*f* and outwardly from the second lateral shoulder support strap 184*f* having second lateral shoulder strap loops 186*f*, 188*f*. The cris-crossing of the bracing members have terminal ends defining head support loops 258*f*, 260*f*, wherein the cris-crossed bracing members form an outer perimeter of the head support region 202*f*, thereby defining a hand grip support region.

Additional third and fourth cross bracing members 180*f*, 182*f* are connected to a respective portion of the angled sections 146*f*, 148*f* forming the back support region. Outer third and fourth elongated longitudinal straps 172*f*, 174*f* extend from the second lateral shoulder support strap 186*f* downwardly across the thigh lifting strap 38*f*, towards the second sling structure 252*f*, across a across a first lateral leg support strap 262*f* terminating at and integrally formed with a second lateral leg support strap 264*f*. Optionally, the second lateral leg support strap 264*f* terminates in two second lateral leg support loops.

In another embodiment of the invention, the first, second, third, and fourth elongated longitudinal support straps 70*f*, 72*f*, 172*f*, 174*f* all have terminal ends terminating at the second lateral leg support strap 264*f*. Optionally, the first and second elongated longitudinal support straps 70*f*, 72*f* have terminal ends defined by elongated support strap loops 270*f*, 272*f*.

In several embodiments of the invention methods of lifting the person in the slings 30*a-e* prove useful in situations when law enforcement officials have persons of interest that they desire to rapidly extract, immobilize and transport to another location. Protesters whom are positioned in a seated or reclined position on the ground. The slings allow the law enforcement official an option that does not require dragging the lifted person 206 but instead provides a method wherein the law enforcement official tilt the lifted person 206 to a first side, places the thigh lifting strap under a second side of the lifted person 206, tilts the lifted person 206 to the second side to ensure that the thigh lifting strap is under the buttocks region. The thigh and buttocks support regions are slipped under the lifted person 206 such that the thigh lifting strap extends upwardly on both sides of the lifted person 206 with the first and second thigh loops available for grasping on each side of the person. Once the immobilized person is properly positioned within the sling the law enforcement official may gently lift the lifted person 206 to securely transport the lifted person 206 to a desired location. If the use of the sling prevents hostile movements attempt while the lifted person 206 is picked up as opposed to being grabbed by their arm pits without use of the sling.

In certain situations the slings 30*c*, 30*d* and 30*e* (shown in FIGS. 4-11) may be used in handcuff situations, as shown for example in particular with reference to FIGS. 9-10. The opening bounded by lateral straps on the lower sling structure are positioned to allow an immobilized handcuffed lifted person, having hands disposed behind the lifted person's back to have the lifted person's hands comfortably disposed through an opening and secured between the lateral straps defining the back support and the buttocks support regions, wherein the weight of the lifted person 206 secured within the opening assists in applying pressure to the handcuffed hand region of the lifted person to further secure the immobilization of the handcuffed person. The handcuffed lifted person may need to be restrained with force or may be compliant such as a participant in a civil disorder or disobedience situation.

An advantage of the loop handles used by the lifting persons 208 provides a respective loop to be grasped in addition to grasping of a respective strap. The weight of the immobilized person on the lifting person's 208 wrist and hand is transferred to the forearms of the lifting person 208 thus allowing for a more comfortable and stronger grip, for easier carrying, and for less strain and fatigue on the lifting person's 208 arm hands, fingers and back. The weight shifting properties of the sling in-use allows transport of the lifted person 206 to be performed more comfortably and for further distances than in slings that do not provide such weight transfer properties. The sling provides a unique support structure of interconnecting straps that allows lifting persons 208 to lift a lifted person 206 without injuring either the lifted or lifting person 208 or persons. The unique design allows for a comfortable transport for a further distance and for lifting people who perform such lifting activities on a repetitive basis.

Another embodiment encompasses a possible law enforcement situation which includes the placement of the lower grid strapping in the back of the unit that allows a law enforcement official to place a person of interest in the sling either while their hands are behind their back in handcuffs or to immobilize the position the hands of person of interest to be initially placed within an associated sling opening and then handcuffed. The placing of the back support lateral strap allows the back support strap to support the lifted persons 206 hands or arms making wearing the sling comfortable and non-invasive.

Another method of using the sling to lift a person includes positioning the back support region adjacent to the back region of the person; positioning and pulling the thigh lifting strap under the thigh region 214; and lifting the lifted person 206 using the sling by applying an upward force to the back support region and to selected portions of the thigh lifting strap that and grasped by the lifting person 208. The method may be used to lift people disposed within any of slings 30*a*-30*f*. With regard to lifting persons using the sling 39*f*, the same method may be used and in addition, once the lifted person is disposed within the sling, the lifted person may recline thereby having both the lifted person's head and leg regions supported by the sling.

In an embodiment of the invention shown in FIG. 8, only two lifting persons 208 are required for transfer. In other embodiments of the invention, anywhere from two people to seven people (as shown in FIG. 13) necessary to extract, transfer, immobilize, and carry a lifted person 206.

The lifting persons 208 do not require special skills or training to use the sling. In several embodiments of the invention, the lifting persons 208 may be located behind the lifted person's 206 back and in front of the person's thigh region 214, or alternatively may be located on either side of the lifted person.

In one embodiment, the lifting persons 208 are located on opposing sides of the person as shown in more detail in FIG. 8. Thus, each lifting person 208 uses a respective one shoulder strap, and a respective thigh loop associated with a same respective side of the lifted person 206 opposing the side of the lifted person where the other lifting person is positioned to lift the lifted person 206.

In another embodiment, one of the lifting persons 208 is positioned respectively behind at the lifting person's 208 back region and grasps the associated shoulder strap loops and another lifting person 208 is located in front of the lifting person's 208 thigh region 214, and grasps each of the thigh loops to lift a lifted person 206. In other embodiments, the lifting persons 208 may be otherwise positioned around the lifted person 206 as necessitated by a particular situation and may use any combination of the loop handles to lift the person accordingly.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

What is claimed is:

1. A sling for extracting and transporting people comprising:

a plurality of lateral support straps;

at least two elongated longitudinal support straps, a first and a second elongated longitudinal support strap interconnected with the plurality of lateral support straps to support a thigh region, a buttocks region, and a back region of a lifted person disposed within the sling to facilitate secure transfer of the lifted person disposed within the sling from a first location to a desired second location, a thigh support region including a thigh lifting strap including two opposing thigh lifting strap first and second ends and adapted to be positioned symmetrically underneath the lifted person's buttocks at an upper portion of the lifted person's thigh to support the lifted person's thigh region;

a back support region that supports the back region extending upwardly from a buttocks support region extending upwardly along the at least two elongated longitudinal straps, the back support region including at least one lateral back support strap extending laterally between the at least two elongated longitudinal support straps;

wherein the at least one back support strap comprises:

a lateral section extending between the two elongated longitudinal support straps; and two angled sections extending outwardly from the lateral section, each of the two angled sections terminating at a respective lateral back support strap first and second end, wherein each lateral back support strap first and second end attaches to at least two predefined overlapping intersection points alone the thigh lifting strap disposed between a respective outer edge of a respective one of the at least two elongated longitudinal straps and a respective first or second end of the thigh lifting strap that each respectively extend from a respective one of the elongated longitudinal strap outer edges located at a respective overlapping intersection point with the at least one back support strap thereby causing the thigh strap to have a curved configuration that adapts to envelope a user's thigh region, wherein the sling is adapted to support a lifted person disposed within the sling in either a seated or a reclined position while being lifted by at least two lifting persons positioned along respective opposing sides of the lifted person disposed within the sling.

2. The sling of claim 1, further comprising:

wherein the buttocks support region that supports the buttocks region of the lifted person including at least two lateral support straps, the buttocks support region extending upwardly along the at least two elongated longitudinal straps from the thigh support region when the sling is positioned such that the thigh support region is oriented below the buttocks support region;

wherein the at least two elongated longitudinal support straps are respectively attached to a respective one of the two lateral buttocks support straps and to the at least one lateral back support strap by integrally attaching each of the at least two elongated longitudinal support straps to a respective one of the lateral buttocks straps and to the at least one lateral back support strap at a respective overlapping intersection at respective predefined distances along each of the two elongated longitudinal support straps.

3. The sling of claim 2, wherein each of the first and the second longitudinal support straps comprise:

an elongated interior surface facing inwardly towards a lifted person disposed within the sling;

an elongated exterior surface facing outwardly from a lifted person disposed within the sling;

an associated width W2 between respective inner and outer first and a second longitudinal support strap edges; and an associated length L2 defined by a distance between opposing respective first and second longitudinal straps first and second ends, wherein the first ends of each of the elongated longitudinal support straps are integrally formed with the thigh lifting strap, and are spaced apart from each other such that the inner edges of each respective elongated longitudinal support strap are substantially equidistant from a longitudinal center of the thigh lifting strap.

4. The sling of claim 2, wherein the sling is adapted to support a lifted person with the lifted person's hands behind the lifted person's back, wherein the hands of a lifted person are disposed within the sling are immobilized between the back and buttocks support region, and wherein the lifted person's arms are supported by the at least one lateral back support strap.

5. The sling of claim 2, wherein a first color associated with the thigh lifting strap is different from a second color associated with each strap associated with the buttocks and back regions so that the contrast between the thigh support region and the other support regions is immediately apparent.

6. The sling of claim 2, wherein the strapping material used to form the thigh, buttocks, and back regions comprises:

a flexible and durable support material that is resistant to heat, UV radiation, snags, wrinkles, and twists.

7. The sling of claim 2, further comprises:

a thigh strap interior surface facing inwardly towards a lifted person when a lifted person is disposed within the sling; and a thigh strap exterior surface facing outwardly from the lifted person when a lifted person is disposed within the sling.

8. The sling of claim 2, wherein the at least one lateral back support strap is spaced apart from the lateral buttocks support straps and has associated intersecting elongated longitudinal strap intersection points located on the back support region and intersecting an associated thigh strap point located along the thigh lifting strap a predefined distance D4 from the respective first and second elongated longitudinal strap outer edges, wherein the at least one lateral back support strap has an intermediary region attaching to respective portions of the elongated longitudinal straps and two terminal ends, a first and a second lateral back strap support terminal end each integrally formed with the thigh lifting strap at a distance D4 from the first and second elongated longitudinal strap outer edges, and wherein the at least one lateral back support strap has an associated length L4 between each of the first and the second lateral back strap support terminal ends.

9. The sling of claim 2, wherein the thigh lifting strap has a width dimension that is wider than a dimension of each of the straps forming the buttocks, and back support regions.

* * * * *